United States Patent [19]

Taylor

[11] 4,286,139

[45] Aug. 25, 1981

[54] COUPLING ASSEMBLY FOR HEATING ELEMENT

[75] Inventor: Eugene D. Taylor, Kenosha, Wis.

[73] Assignee: J. I. Case Company, Racine, Wis.

[21] Appl. No.: 106,576

[22] Filed: Dec. 26, 1979

[51] Int. Cl.[3] ..... H05B 3/02; H05B 3/82; F02N 17/06

[52] U.S. Cl. ..... 219/208; 123/142.5 E; 138/90; 219/318; 219/336; 219/536; 220/235; 277/110; 285/196

[58] Field of Search ..... 219/316, 318, 335, 336, 219/205, 208, 536; 285/196; 277/110, 111, 113, 115; 220/234–237; 123/142.5 E, 142.5 R; 138/90

[56] References Cited

U.S. PATENT DOCUMENTS

| | | | |
|---|---|---|---|
| 1,335,117 | 3/1920 | Kofoed et al. | 220/235 X |
| 2,783,352 | 2/1957 | McKay | 219/208 X |
| 2,824,945 | 2/1958 | Derumaux | 219/208 X |
| 3,211,888 | 10/1965 | Windsor | 219/205 X |
| 3,280,298 | 10/1966 | Klancke et al. | 219/208 |
| 3,456,094 | 7/1969 | Klancke et al. | 219/208 |

*Primary Examiner*—A. Bartis

*Attorney, Agent, or Firm*—Cullen, Sloman, Cantor, Grauer, Scott & Rutherford

[57] ABSTRACT

A coupling assembly for mounting a heating element to an opening in an engine block. The coupling assembly includes a guide member which prevents a blow-out of the coupling assembly from the engine block opening when high pressure is exerted against the coupling assembly. The coupling assembly includes an in-line arrangement of an outer clamping ring, a retainer ring, an O-ring seal, and an inner guide sleeve which are concentrically mounted to a threaded clamping sleeve having fixed at one end an electric heating element sized and shaped for insertion into the engine block through the opening. The O-ring seal and retainer ring are mounted onto the outer periphery of a first annular portion of the guide sleeve and a clamping nut on the threaded sleeve presses the clamping ring and retainer ring against the O-ring to compress the O-ring into sealing engagement with the walls of the opening. An elongated second annular portion of the guide sleeve extends interiorly of the engine block when the coupling assembly is installed. Pressure from the engine coolant against the guide sleeve tends to push it outwardly of the engine block, but the second annular portion of the guide sleeve prevents the coupling assembly from tilting or pivoting with respect to the axis of the engine block opening because of the elongated longitudinal extent of the guide sleeve's second annular portion.

1 Claim, 5 Drawing Figures

COUPLING ASSEMBLY FOR HEATING ELEMENT

BACKGROUND OF THE INVENTION

The present invention relates to a coupling assembly for mounting a heating element to an opening in an engine block, and more particularly, to a guide member which prevents blow-out of the coupling assembly from the engine block opening when pressure is exerted against the coupling assembly by the engine coolant after the engine has reached an operating or higher temperature.

In colder temperatures, a diesel engine is difficult to start until the air which is drawn into the cylinders becomes heated to a high temperature (approx. 700°-900° C). Diesel fuel can be injected into the cylinders and spontaneously ignited only when the intake air has reached this highly heated state. It is conventional to provide an engine block heater for use in diesel engines which warms the engine coolant to assist in the starting of the engine. The heater element warms the engine coolant prior to engine starting, and the warmed engine coolant circulates around the cylinder walls to thereby help in the heating of the air drawn into the cylinders.

The engine block heater includes a heating element which is mounted by a coupling assembly to an opening through the side of the engine block. The heating element is disposed inside the engine block to heat the engine coolant. After the engine has been started and it reaches its normal operating temperature and above, the pressure exerted by the hot engine coolant against the coupling assembly is substantial and has resulted in some instances in a blowout of the coupling assembly from the engine block opening. The prior art coupling assemblies have been ineffective in preventing a blow-out of the engine block heater when the engine coolant becomes highly heated and exerts substantial pressure against the coupling assembly.

Thus, the disadvantages of present coupling assemblies for engine block heaters have resulted in the present invention which effectively reduces or eliminates the possibility of engine block heater blow-out.

SUMMARY OF THE INVENTION

In accordance with the present invention, a coupling assembly is provided for mounting a heating element to an opening in an engine block. The heating element is generally L-shaped, and the coupling assembly for mounting the element to the engine block opening is fixed to the short leg of the heating element.

In a first embodiment of the present invention, the coupling assembly includes an in-line arrangement of an outer clamping ring, a retainer ring, an O-ring seal, and an inner guide sleeve, which are concentrically mounted to a threaded clamping sleeve. The clamping sleeve is fixed to the short leg of the heating element. During installation, the coupling assembly is aligned with the opening in the engine block and the guide sleeve end of the coupling assembly is pressed inwardly such that when the assembly is tightened and finally secured, a portion of the guide sleeve is disposed interiorly of the engine block. If the engine coolant exerts substantial pressure against the coupling assembly, the guide sleeve prevents the assembly from tilting or pivoting movement about the longitudinal axis of the engine block opening which has heretofore broken the seal of the assembly and resulted in the undesirable blow-out of the heating element.

The O-ring seal and retainer ring are mounted onto the outer periphery of a first annular portion of the guide sleeve. The clamping ring is pressed against the retainer ring by a clamping nut which is tightened on the threaded clamping sleeve. As the clamping nut is tightened, the O-ring seal expands in response to compression by the retainer ring and the guide sleeve is pushed into sealing engagement with an annular sealing ring on the threaded clamping sleeve. An elongated second annular portion of the guide sleeve, which has a diameter slightly less than the diameter of the opening in the engine block, is pressed inwardly and the clamping nut is tightened such that one end of the guide sleeve extends interiorly of the engine block. Pressure from the engine coolant against the guide sleeve tends to push it outwardly of the engine block, but the second annular portion of the guide sleeve prevents the coupling assembly from tilting or pivoting because of the elongated longitudinal extent of the guide sleeve's second annular portion.

Thus, the guide sleeve performs at least two functions. The first annular portion of the guide sleeve provides a support for the O-ring seal and retainer ring to keep them aligned and in place as the outer clamping ring compresses the O-ring seal. Further, the elongated second annular portion of the guide sleeve extends interiorly of the engine block when installed to prevent any tilting or pivoting of the coupling assembly about the axis of the engine block opening when pressure is exerted against it.

In a second embodiment of the present invention, the coupling assembly includes a differently configured guide sleeve which is press-fitted into the opening in the engine block. The guide sleeve includes a planar base portion and an integral annular portion having a lontigudinal axis perpendicular to the base portion. The base portion of the guide sleeve is mounted on the threaded clamping sleeve which is fixed to the short leg of the heating element. The guide sleeve is pressed into sealing engagement with an annular sealing ring on the threaded clamping sleeve by a clamping nut which is tightened on the clamping sleeve.

An advantage of the second embodiment of the coupling assembly is that the guide sleeve accommodates a special installation tool which is used for press-fitting the guide sleeve into the opening in the engine block. The tool is brought to bear against the planar portion of the guide sleeve and held in place by the annular portion of the guide sleeve which permits the coupling assembly to be aligned with and secured to the engine block opening conveniently and in an expeditious manner.

Other advantages and meritorious features of the coupling assembly of the present invention will be more fully understood from the following description of the preferred embodiment, the appended claims, and the drawings, a brief description of which follows.

DETAILED DESCRIPTION OF THE INVENTION

Figure 1:
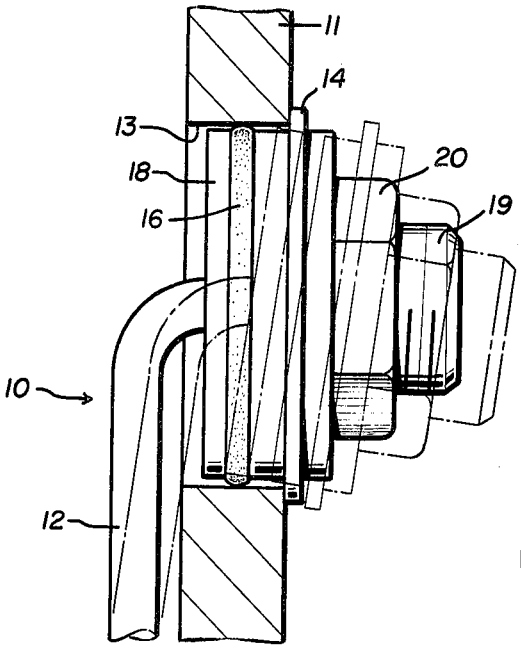
FIG. 1 PRIOR ART
FIG. 1 is a side elevational view of a prior art coupling device for an engine block heater element.

Referring to FIG. 1, it is conventional to provide an engine block heater 10 for use in diesel engines wherein the heater warms the engine coolant to assist in the starting of the engine. The conventional engine block heater 10 includes a heating element 12 which is mounted by a coupling assembly to an opening 13 through the side of the engine block 11. The coupling assembly, illustrated in FIG. 1, includes an outer clamping ring assembly 14, an O-ring seal 16, and an inner retainer member 18, which are concentrically mounted to a threaded clamping sleeve 19. The clamping sleeve 19 is fixed to the short leg of the heating element 12. The clamping ring assembly 14 is pressed against the O-ring seal 16 by a clamping nut 20 which is tightened on the threaded clamping sleeve 19. The solid line position of FIG. 1 is illustrative of the prior art coupling assembly when it is installed.

The heating element 12 warms the engine coolant prior to engine starting, and the warmed engine coolant circulates around the cylinder walls to thereby help in the heating of the air drawn into the cylinders. After the engine has been started and it reaches its normal operating temperature and above, the pressure exerted by the hot engine coolant against the coupling assembly illustrated in FIG. 1 is substantial and has resulted in some instances in a blowout of the coupling assembly (i.e., twisting or pivoting of the coupling assembly with respect to the longitudinal axis of the engine block opening) from the solid line position shown in FIG. 1 to the phantom line position. The prior art coupling assembly as shown in FIG. 1 has been ineffective in preventing blowout of the engine block heater when the engine coolant becomes highly heated and exerts substantial pressure against the coupling assembly.

Figure 2:
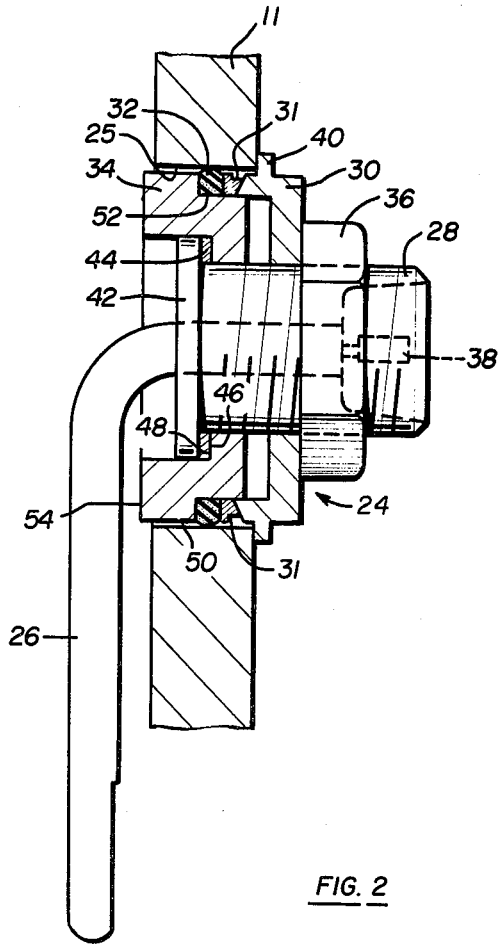
FIG. 2 is a side elevational view, partially in cross-section, illustrating a first embodiment of the coupling assembly of the present invention in its installed position.
Figure 3:
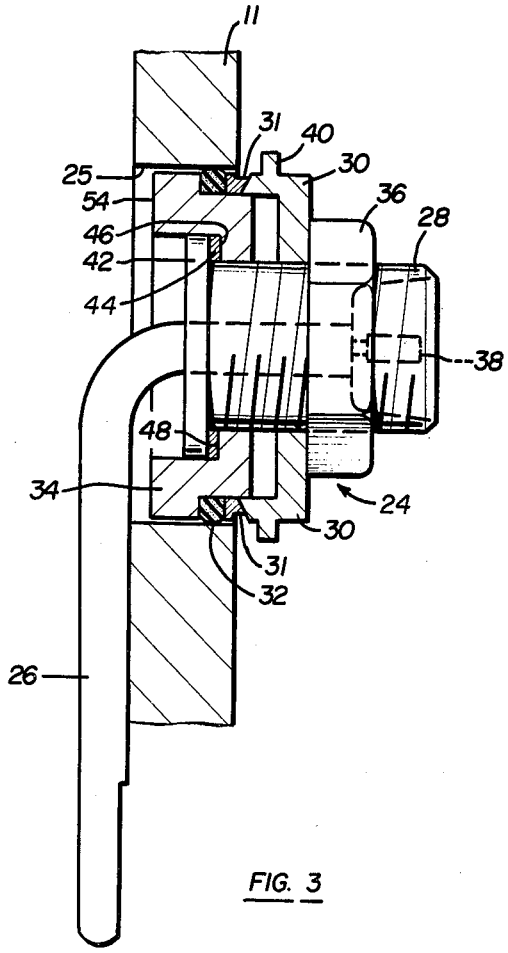
FIG. 3 is a side elevational view, partially in cross-section, of the coupling assembly shown in FIG. 2 and illustrating the guide sleeve which prevents blow-out of the coupling assembly.

A preferred embodiment of a coupling assembly made in accordance with the teachings of the present invention is illustrated in FIGS. 2–3. The heating element 26 is generally L-shaped and the coupling assembly 24, for mounting the element to the engine block opening 25, is fixed to the short leg of the heating element. Referring to FIG. 2, the coupling assembly includes an in-line arrangement of an outer clamping ring 30, a retaining ring 31, an O-ring seal 32, and an inner guide sleeve 34, which are concentrically mounted to a threaded clamping sleeve 28. The clamping sleeve 28 is fixed to the short leg of the heating element 26. Electrical connector 38 is connected to a source of electricity for causing resistive heating element 26 to generate heat within engine block 11.

During installation, coupling assembly 24 is aligned with opening 25 in engine block 11 and guide sleeve 34 is pressed inwardly such that when the assembly is tightened and finally secured, a portion of guide sleeve 34 is disposed interiorly of the engine block 11. If the engine coolant exerts substantial pressure against the coupling assembly, guide sleeve 34 prevents the assembly from tilting or pivoting movement about the axis of engine block opening 25 which has heretofore broken seal 32 of the assembly and resulted in the undesirable blow-out of the heating element 26.

The O-ring seal 32 and retainer ring 31 are mounted onto the outer periphery 52 of a first annular portion of the guide sleeve 34. The clamping ring 30 is pressed against the retainer ring 31 by a clamping nut 36 which is tightened on the threaded clamping sleeve 28. As the clamping nut 36 is tightened, O-ring seal 32 expands in response to compression against it by retainer ring 31. Guide sleeve 34 is pushed into sealing engagement with gasket 44 and annular sealing ring 42 on the threaded clamping sleeve 28 such that surface 48 of guide sleeve 34 sealingly engages surface 46 of gasket 44.

An elongated second annular portion of the guide sleeve 34 includes a periphery 50 having a diameter slightly less than the diameter of the opening 25 in the engine block. Guide sleeve 34 is pressed inwardly during installation and clamping nut 36 is tightened such that its rim portion 40 abuts against the outer side wall of engine block 11 and guide sleeve 34 extends interiorly of the engine block as illustrated in FIG. 2. Pressure from the engine coolant against the end 54 of guide sleeve 34 tends to push it outwardly of the engine block, but the second annular portion of the guide sleeve 34 prevents the coupling assembly 24 from tilting or pivoting because of the elongated longitudinal extent of the guide sleeve's second annular portion.

Thus, the guide sleeve 34 performs at least two functions. The first annular portion provides a support 52 for O-ring seal 32 and retaining ring 31 to keep them aligned and in place as the outer clamping ring 30 compresses the O-ring seal. Further the periphery 50 of the elongated second annular portion of the guide sleeve extends interiorly of the engine block, when installed, to prevent any tilting or pivoting of the coupling assembly when pressure is exerted against it. A substantial amount of engine coolant pressure may cause the coupling assembly to be displaced outwardly such as illustrated in FIG. 3, but guide sleeve 34 prevents the coupling assembly from tilting or pivoting once it has reached the position illustrated in FIG. 3.

Figure 4:
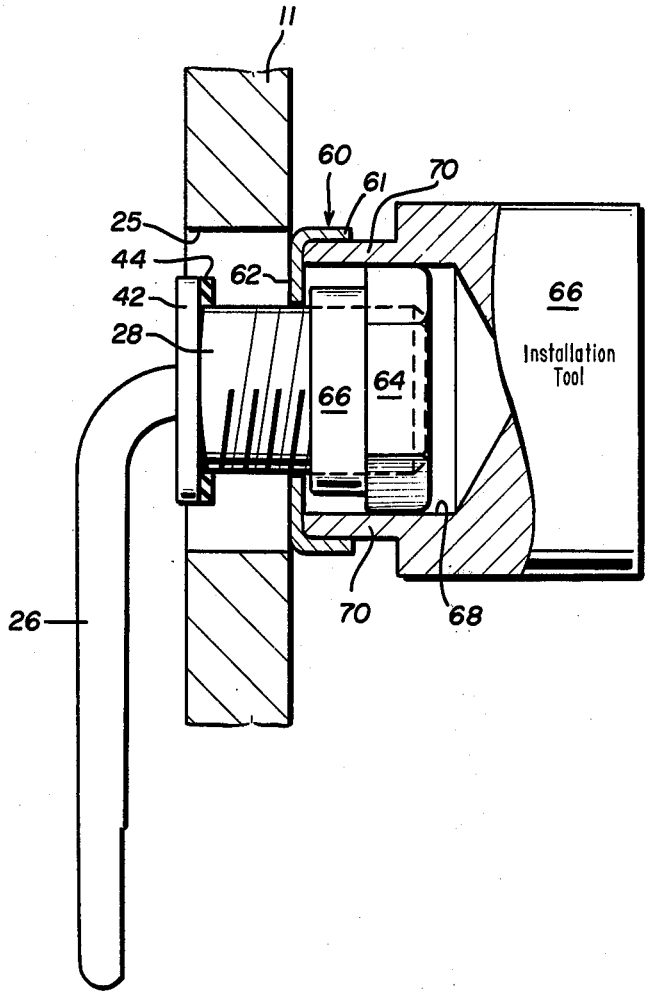
FIG. 4 is a side elevation view of a second embodiment of the coupling assembly and illustrating the installation of the coupling assembly by using a special installation tool which is accommodated by the guide sleeve.
Figure 5:
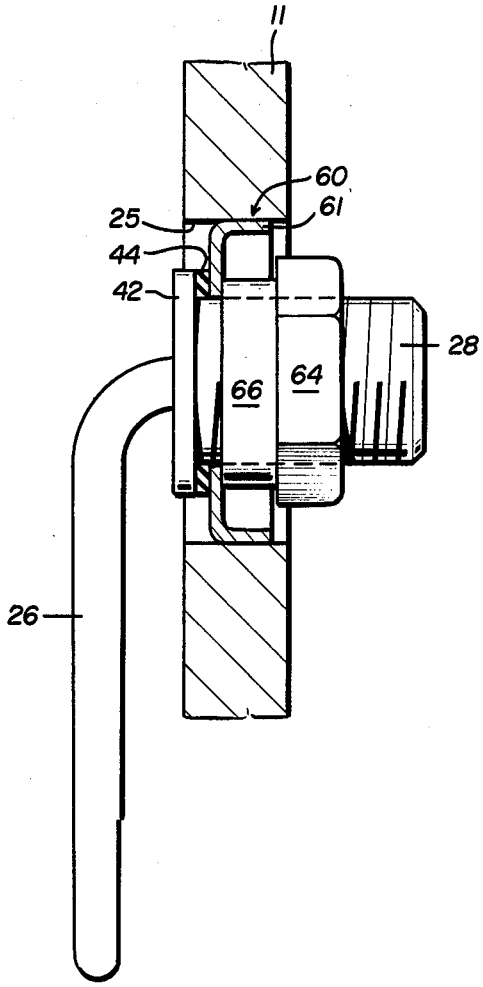
FIG. 5 is a side elevational view of the coupling assembly illustrated in FIG. 4 and shown in its installed position.

In a second embodiment of the present invention as illustrated in FIGS. 4–5, the coupling assembly includes a differently configured guide sleeve 60 which is press-fitted into opening 25 in engine block 11. Guide sleeve 60 includes a planar base portion 62 and an integral annular portion 61 having a longitudinal axis perpendicular to the base portion. Base portion 62 of guide sleeve 60 is mounted on the threaded clamping sleeve 28 which is fixed to the short leg of the heating element 26. Guide sleeve 60 is pressed into sealing engagement with gasket 44 and annular sealing ring 42 on the threaded clamping sleeve 28 by a clamping nut 64 and spacer 66 which are tightened against guide sleeve 60.

An advantage of the second embodiment of the coupling assembly is that the guide sleeve 60 accommodates a special installation tool 66 which includes cavity 68 and pressure-applying portion 70 and which is used for press-fitting the guide sleeve into opening 25 in engine block 11. Tool portion 70 is brought to bear against planar portion 62 of guide sleeve 60 and held in place by annular portion 61 of the guide sleeve which permits the coupling assembly to be aligned with and secured to the engine block opening conveniently and in an expeditious manner as illustrated in FIGS. 4–5. A further advantage of guide sleeve 60 is that it can be press-fitted into the engine block opening 25 with a wide tolerance variation between the outside diameter of guide sleeve 60 and the diameter of opening 25. If guide sleeve 60 was solid, the diameter of opening 25 and the outside diameter of sleeve 60 would have to be closely controlled in order to obtain a proper press-fit which would result in increased manufacturing and installation costs.

It will be apparent to those skilled in the art that the foregoing disclosure is exemplary in nature, rather than limiting, the invention being limited only by the appended claims.

I claim:

1. In an electric heater assembly which is mountable in an opening through a wall in an engine block, said heater assembly including an electric heating element sized and shaped for insertion into the engine block through said opening in said wall, the improvement comprising:

a coupling assembly for mounting said heating element to said opening through said engine block wall, said coupling assembly including an elongated clamping sleeve having one end fixed to said heating element, said clamping sleeve being sized and shaped to extend into the engine block opening in spaced relationship thereto, said sleeve being of a length such that the other end thereof extends outwardly of the engine block through said opening when the heating element is inserted into the engine block, and a circumferential sealing ring on said one end of the clamping sleeve;

an annular guide sleeve of a diameter closely conforming to the diameter of the engine block opening, said guide sleeve being slidable on said clamping sleeve and closely fitting into said opening, said circumferential sealing ring limiting the movement of said guide sleeve toward said heating element, a sealing gasket mounted between said guide sleeve and said sealing ring, said guide sleeve having a first annular reduced diameter shoulder portion forming a seat, a resiliently compressible annular seal means mounted on said seat, an annular retainer ring mounted on said seat outwardly of said seal means, said seal means and retainer ring closely fitting said opening;

means mounted on said clamping sleeve for pressing said retainer ring against said seal means to compress the seal means into tight engagement with the wall of the engine block opening and for pressing said guide sleeve toward said sealing ring to compress the sealing gasket therebetween, said pressing means including an annular clamping ring axially movable on said clamping sleeve toward said retainer ring to press said retainer ring and guide sleeve, said annular clamping ring including a rim portion that abuts against the outer side of the engine block wall when said heater assembly is installed in said engine block opening, and a clamping member mounted on said clamping sleeve for preventing movement of said clamping ring away from said retainer ring; and said guide sleeve including a second annular shoulder portion having a uniform diameter greater than said first shoulder portion but slightly less than the diameter of the opening in the engine block, said second annular shoulder portion having an elongated longitudinal extent such that said second annular shoulder portion is partially disposed within said engine block when said heater assembly is installed in said engine block opening to prevent said heater assembly from tilting with respect to the longitudinal axis of said opening in said engine block.

* * * * *